US010464189B2

(12) United States Patent
Oseki et al.

(10) Patent No.: US 10,464,189 B2
(45) Date of Patent: Nov. 5, 2019

(54) METHOD FOR MANUFACTURING POLISHING HEAD, POLISHING HEAD, AND POLISHING APPARATUS

(71) Applicant: SHIN-ETSU HANDOTAI CO., LTD., Tokyo (JP)

(72) Inventors: Masaaki Oseki, Nishigo-mura (JP); Michito Sato, Nishigo-mura (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 200 days.

(21) Appl. No.: 15/557,499

(22) PCT Filed: Mar. 3, 2016

(86) PCT No.: PCT/JP2016/001148
§ 371 (c)(1),
(2) Date: Sep. 12, 2017

(87) PCT Pub. No.: WO2016/166928
PCT Pub. Date: Oct. 20, 2016

(65) Prior Publication Data

US 2018/0043500 A1 Feb. 15, 2018

(30) Foreign Application Priority Data

Apr. 16, 2015 (JP) ..... 2015-084098

(51) Int. Cl.
*B24B 37/26* (2012.01)
*B24D 18/00* (2006.01)
(Continued)

(52) U.S. Cl.
CPC ..... *B24B 37/26* (2013.01); *B24B 37/24* (2013.01); *B24B 37/30* (2013.01); *B24B 41/06* (2013.01);
(Continued)

(58) Field of Classification Search
CPC ..... B24B 37/04; B24B 37/10; B24B 37/24; B24B 37/26; B24B 37/30; B24B 41/06; B24D 18/0027
See application file for complete search history.

(56) References Cited

U.S. PATENT DOCUMENTS 4,897,966 A 2/1990 Takahashi
9,266,216 B2 * 2/2016 Masumura ..... B24B 37/30
(Continued)

FOREIGN PATENT DOCUMENTS

JP S63-52967 A 3/1988
JP 2013-166200 A 8/2013
WO 2013/001719 A1 1/2013

OTHER PUBLICATIONS

Apr. 26, 2016 Search Report issued in International Patent Application No. PCT/JP2016/001148.

*Primary Examiner* — Timothy V Eley
(74) *Attorney, Agent, or Firm* — Oliff PLC

(57) ABSTRACT

A method for manufacturing a polishing head, includes: forming, on a lower end surface of an intermediate plate, a groove which extends from an inlet of an incompressible fluid to an outer peripheral portion of the intermediate plate and a groove which extends from an outlet of air to the outer peripheral portion of the intermediate plate, also including, after attaching an elastic film to a lower end surface of a rigid ring and coupling an upper end surface of the rigid ring with the lower end surface of the intermediate plate to form a space section: depressurizing the inside of the space section; and discharging the air in the space section from the outlet while pouring the incompressible fluid into the space section from the inlet after the depressurizing, and closing the inlet and outlet to seal the incompressible fluid in the space section.

6 Claims, 4 Drawing Sheets

(51) Int. Cl.

| | |
|---|---|
| ***B24B 37/30*** | (2012.01) |
| ***B24B 41/06*** | (2012.01) |
| ***B24B 37/24*** | (2012.01) |
| ***B24B 37/04*** | (2012.01) |

(52) U.S. Cl.
CPC ..... *B24D 18/0027* (2013.01); *B24D 18/0045* (2013.01); *B24B 37/04* (2013.01)

(56) References Cited

U.S. PATENT DOCUMENTS

| | | | | |
|---|---|---|---|---|
| 2003/0008604 | A1* | 1/2003 | Boo | B24B 37/30 451/388 |
| 2003/0203708 | A1* | 10/2003 | Liu | B24B 37/042 451/53 |
| 2009/0291623 | A1* | 11/2009 | Masumura | B24B 37/30 451/287 |
| 2010/0291838 | A1* | 11/2010 | Masumura | B24B 37/30 451/9 |
| 2011/0053474 | A1* | 3/2011 | Moriya | B24B 37/30 451/288 |
| 2012/0040592 | A1* | 2/2012 | Chen | B24B 37/015 451/53 |
| 2014/0113531 | A1 | 4/2014 | Masumura | |
| 2015/0017890 | A1 | 1/2015 | Masumura | |

* cited by examiner

METHOD FOR MANUFACTURING POLISHING HEAD, POLISHING HEAD, AND POLISHING APPARATUS

TECHNICAL FIELD

The present invention relates to a method for manufacturing a polishing head, a polishing head, and a polishing apparatus including the polishing head.

BACKGROUND ART

In recent years, a demand concerning flatness of a wafer such as a silicon wafer has been increased more than ever, and fabricating a wafer having higher flatness in single-side polishing has been demanded. Further, to provide a wafer having high flatness with excellent reproducibility, a polishing head including a rubber film which holds the wafer, a space section which is in contact with the rubber film, and an incompressible fluid which is sealed in the space section is used (see, e.g., Patent Literature 1).

According to such a polishing head, since a shape of a surface of the rubber film can be appropriately adjusted by the incompressible fluid, when the surface of the rubber film is appressed against an entire back surface of the wafer to press the wafer, polishing can be carried out. Consequently, a stock removal of the wafer can be uniformed on an entire polishing surface, and the wafer with high flatness can be fabricated. Further, since the shape of the surface of the rubber film which adsorbs the wafer can be controlled to be constant by the incompressible fluid, the wafer with high flatness can be provided with excellent reproducibility.

However, to uniform the shape of the surface of the rubber film which adsorbs the wafer, the incompressible fluid must be sealed in the space section in the polishing; head without mixing air in manufacture of the polishing head. That is because a pressure in a portion where the air is present is different from those in other portions when the air is mixed, the shape of the surface of the rubber film cannot be controlled to be constant, and the wafer cannot be uniformly pressed. Furthermore, when the air is mixed, a volume of the incompressible fluid which is to be sealed in the polishing head largely varies, and the shape of the polished wafer also largely varies. Thus, in manufacture of the polishing head, the air must be prevented from remaining particularly in the space section where the incompressible fluid is sealed in.

Thus, to prevent the air from being mixed, parts of the polishing head are immersed in the incompressible fluid, and the polishing head is manually assembled in the incompressible fluid in some cases. However, according to this technique, controlling an amount of the incompressible fluid to be sealed in is difficult. Moreover, since the polishing head is assembled in the incompressible fluid, workability is considerably degraded. Additionally, a polishing head which is used for polishing of a large-diameter wafer having a diameter of 300 mm or more has a large size and a very heavy weight, and hence a problem arises in a safety aspect as well as the workability. Further, when the incompressible fluid to be sealed in is harmful to human bodies, work itself is impossible.

On the other hand, as described, below, there is also a technique to assemble the polishing head in air rather than the incompressible fluid. According to this technique, first, as shown in an upper part of FIG. 6, a rigid ring 102, an intermediate plate 104, and a rubber film 103 are assembled, and a space section 105 where an incompressible fluid is sealed in is formed in the polishing head. Furthermore, in the intermediate plate 104, an inlet 107 through which the incompressible fluid is poured and an outlet 108 through which air is discharged are formed. Then, the inside of the space section 105 is depressurized. Thereafter, the incompressible fluid is poured into the space section 105 from the inlet 107 communicating with the space section 105 and, at the same time, the air remaining in the space section 105 is discharged from the outlet 108. As shown in a lower part of FIG. 6, after a sufficient amount of the incompressible fluid 106 is poured, the inlet 107 and the outlet 108 are closed with lids 109 (this technique will be also referred to as a depressurizing and sealing method hereinafter). According to this depressurizing and sealing method, assembling the polishing head in the air enables greatly improving the workability. Moreover, an amount of the incompressible fluid to be sealed in can be easily controlled.

CITATION LIST

Patent Literature

Patent Literature 1: Japanese Unexamined Patent Application Publication No. 2013-166200

DISCLOSURE OF INVENTION

Problem to be Solved by the Invention

However, when the incompressible fluid is sealed in the space section in the polishing head by the depressurizing and sealing method, a large amount of air remains in the polishing head. For this reason, since the inlet and the outlet are provided in a central portion with a small thickness due to a structure of the polishing head, the incompressible fluid closes the outlet on an early stage before discharging the air remaining at an outer periphery of the space section, and hence the remaining air cannot be discharged.

To solve this problem, it is effective to provide the inlet and the outlet in the vicinity of the outer peripheral portion in such a manner that a distance between the inlet and the outlet becomes as large as possible. However, the outer peripheral portion of the polishing head has a large thickness from the beginning, the outer peripheral portion of the polishing head becomes thick due to a height of a coupler connected to each of the inlet and the outlet, and hence a weight of the polishing head increases. Additionally, a volume of the space section in the polishing head increases, and responsiveness of pressurization or depressurization to the wafer at the time of polishing becomes poor. Thus, providing the inlet or the outlet in the outer peripheral portion of the polishing head is not practical.

Further, to reduce an amount of the remaining air, as shown in FIG. 7, the polishing head can be mounted at a slant so that a position of the outlet 108 becomes higher than that of the inlet 107, and the incompressible fluid 106 can be poured into the space section 105 in this state (an upper left part in FIG. 7). With this arrangement, first, since the incompressible fluid 106 starts to be stored in a direction opposite to the outlet 108 (an upper: right part in FIG. 7), a time required to close the outlet 108 with the poured incompressible fluid 106 can be increased, and hence an amount of air to be discharged can be increased (a lower left part in FIG. 7). However, it is difficult to discharge from the polishing head the air which is present at a position higher than the outlet 108, and the amount of the remaining air eventually increases (a lower right part in FIG. 7). In this manner, the volume of the incompressible fluid to be sealed in varies depending on an amount of the remaining air.

In view of such a problem as described above, it is an object, of the present invention to provide a method for manufacturing a polishing head, which has excellent workability, facilitates controlling an amount of an incompressible fluid, and can reduce an amount of air remaining in a space section at the time of manufacturing the polishing head having the incompressible fluid sealed in the space section.

Furthermore, it is another object, of the present invention to provide a polishing head and a polishing apparatus including the polishing head, which enable reducing an amount of air remaining in a space section having an incompressible fluid sealed therein and manufacturing a wafer having high flatness with excellent reproducibility.

Means for Solving Problem

To achieve the problem, the present invention provides a method for manufacturing a polishing head which includes: an annular rigid ring; an elastic film attached to a lower end surface of the rigid ring by uniform tensile force; a discoid intermediate plate coupled with an upper end surface of the rigid ring; a space section partitioned by the lower end surface of the intermediate plate, an upper surface of the elastic film, and an inner peripheral surface of the rigid ring; and an incompressible fluid sealed in the space section, and rubs and polishes a front, surface of a wafer with a polishing pad attached to an upper side of a turntable while holding a back surface of the wafer on a lower surface portion of the elastic film, the method including, before coupling the intermediate plate with the upper end surface of the rigid ring: forming, in the intermediate plate, an inlet through which the incompressible fluid is poured into the space section and an outlet through which air is discharged from the space section at the time of pouring the incompressible fluid; and forming, on a lower end surface of the intermediate plate, a groove which extends from the inlet to an outer peripheral portion of the intermediate plate and a groove which extends from the outlet to the outer peripheral portion of the intermediate plate, the method including, after attaching the elastic film to the lower: end surface of the rigid ring and coupling the upper end surface of the rigid ring with the lower end surface of the intermediate plate having the grooves formed thereon to form the space section: depressurizing the inside of the space section; and discharging the air in the space section from the outlet while pouring the incompressible fluid into the space section from the inlet after the depressurizing, and closing the inlet and outlet to seal the incompressible fluid in the space section.

In this manner, when such grooves as described above are formed on the surface of the intermediate plate on the space section side in advance and the incompressible fluid is sealed in, a flow of the incompressible fluid can be appropriately controlled at the time of pouring the incompressible fluid. That is, before the incompressible fluid closes the outlet, the air remaining in the space section can be discharged. Moreover, according to such a manufacturing method, the workability is good, and an amount of the incompressible fluid to be poured can be easily controlled.

At this time, in sealing the incompressible fluid in the space section, it is preferable to pour the incompressible fluid into the space section while mounting the intermediate plate at a slant so that the inlet is placed below the outlet.

With this arrangement, an amount of the air remaining in the space section can be further reduced.

Additionally, at this time, it is preferable to use, as the intermediate plate, a member whose lower end surface on which the grooves are formed has a convex shape.

With this arrangement, an amount of the air remaining in the space section can be further assuredly reduced.

Further, to achieve the object, the present invention provides a polishing head including: am annular rigid ring; an elastic film attached to a lower end surface of the rigid ring by uniform tensile force; a discoid intermediate plate coupled with an upper end surface of the rigid ring; a space section partitioned by the lower end surface of the intermediate plate, an upper surface of the elastic film, and an inner peripheral surface of the rigid ring; and an incompressible fluid sealed in the space section, and rubs and polishes a front surface of a wafer with a polishing pad attached to an upper side of a turntable while holding a back surface of the wafer on a lower-surface portion of the elastic film, the polishing head being characterized in that the intermediate plate includes, on the lower end surface thereof: an inlet through which the incompressible fluid is poured into the space section; an outlet through which air is discharged from the space section; a groove which extends from the inlet, to an outer peripheral portion of the intermediate plate; a groove which extends from the outlet to the outer peripheral portion of the intermediate plate; and lid sections which close the inlet and the outlet.

In such a polishing head, an amount of the air remaining in the space section having the incompressible fluid sealed therein is small, the shape of the surface of the elastic film on which the wafer is held can be easily controlled, and hence the wafer with high flatness can be manufactured with good reproducibility.

Furthermore, to achieve the object, the present invention provides a polishing apparatus including: a polishing pad attached to an upper side of a turntable; a polishing agent supply mechanism configured to supply a polishing agent onto the polishing pad; and the polishing head, the polishing apparatus being characterized in that a workpiece is held by the polishing head, and a front surface of the workpiece is rubbed and polished with the polishing pad attached to the upper side of the turntable.

The polishing apparatus including the polishing head, can manufacture the wafer having high flatness with the good reproducibility.

Effect of the Invention

According to the method for manufacturing a polishing head of the present invention, an amount of the air remaining in the space section at the time of sealing in the incompressible fluid can be greatly reduced. Furthermore, this manufacturing method provides the excellent workability, and facilitates controlling an amount of the incompressible fluid to be sealed in.

Moreover, according to the polishing head of the present invention, an amount of the air remaining in the space section having the incompressible fluid sealed therein is small, the shape of the surface of the elastic film on which the wafer is held can be readily controlled, and hence the wafer having high flatness can be manufactured with good reproducibility. Additionally, the polishing apparatus including such a polishing head of the present invention can provide the same effect.

BEST MODE(S) FOR CARRYING OUT THE INVENTION

Although an embodiment according to the present invention will now be described hereinafter, the present invention is not restricted thereto.

As described above, the depressurizing and sealing method provides excellent workability and facilitates control over an amount of an incompressible fluid to be sealed in. However, the incompressible fluid which has been poured on an early stage before discharging a sufficient amount of air closes an outlet and enters, so to call, a state where an inlet and the outlet are short-circuited through the incompressible fluid, and hence there arises a problem that a large amount of air remains in a space section. On the other hand, the present inventors and others have discovered that an amount of remaining air can be reduced by forming grooves on a surface of an intermediate plate which partitions the space section to control a flow of the incompressible fluid in the space section, particularly control the incompressible fluid so that it first flows through an outer peripheral portion of the space section, thereby bringing the present invention to completion.

Figure 1:
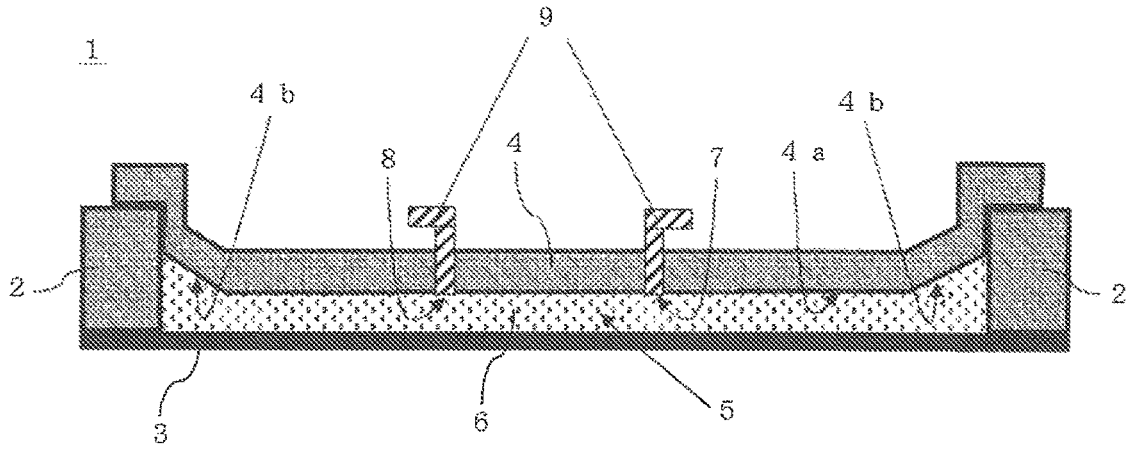
FIG. 1 is a schematic cross-sectional view showing an example of a polishing head according to the present invention.

First, a polishing head according to the present invention will be described with reference to FIG. 1. As shown in FIG. 1, a polishing head 1 according to the present invention includes an annular rigid ring 2, an elastic film 3 attached to a lower end surface of the rigid ring 2 by uniform tensile force, a discoid intermediate plate 4 coupled with an upper end surface of the rigid ring 2, a space section 5 partitioned by a lower end surface of the intermediate plate 4, an upper surface of the elastic film 3, and an inner peripheral surface of the rigid ring 2, and an incompressible fluid 6 sealed in the space section 5. Furthermore, in the intermediate plate 4, an inlet 7 and an outlet 8 which are used to seal the incompressible fluid 6 in the space section 5 in manufacture of this polishing head 1 are formed. Moreover, lid sections 9 which close the inlet 7 and the outlet 8 to seal in the incompressible fluid 6 are provided. It is to be noted that, in this case, such one-touch couplers 9 as shown in FIG. 1 which can open/close the inlet 7 and the outlet 8 and have good workability can be used as the lid sections 9.

Figure 2:
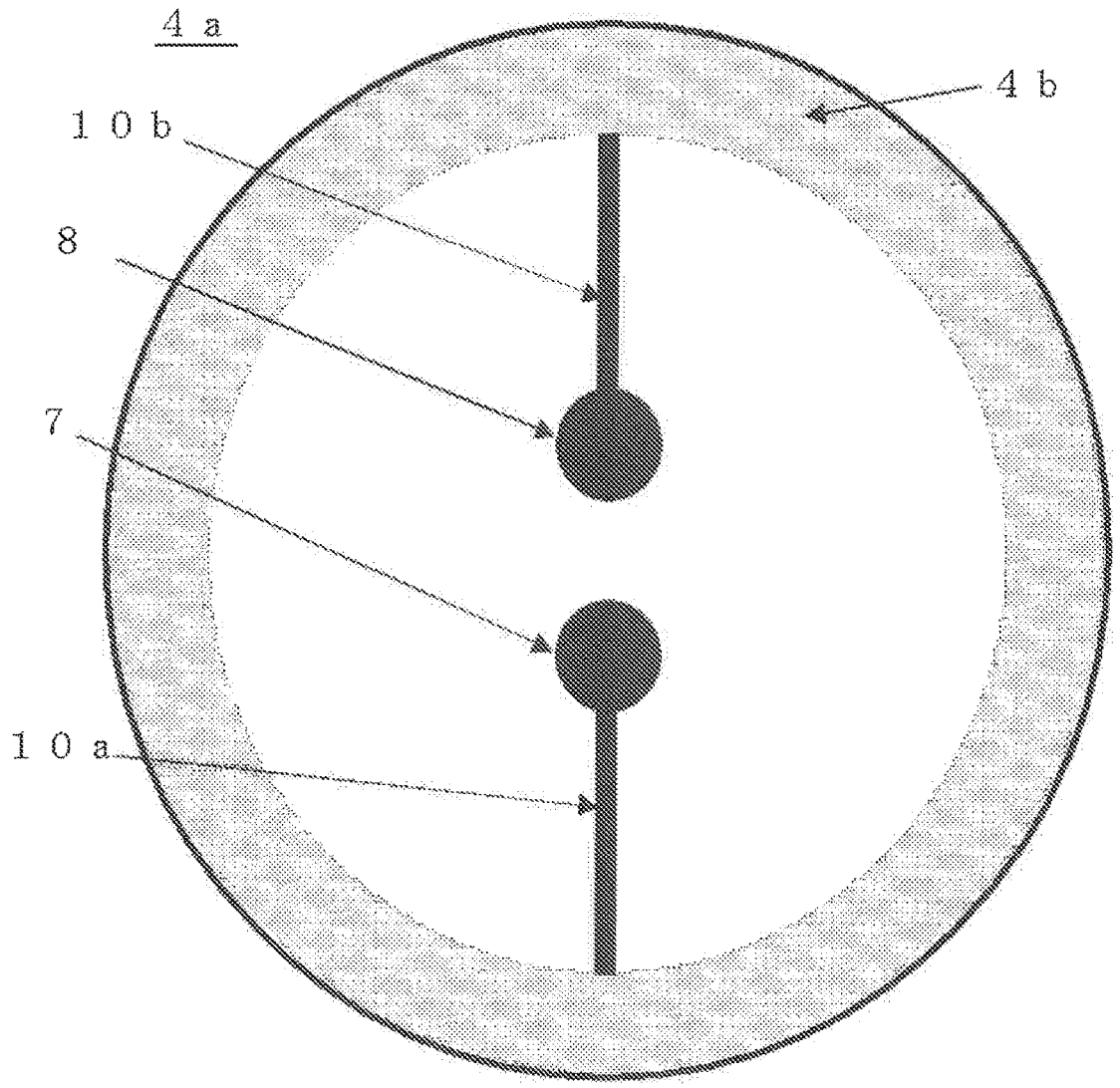
FIG. 2 is a schematic view showing an example of a lower end surface of an intermediate plate in the polishing head according to the present invention.

Additionally, as shown in FIG. 2, on the lower end surface 4*a* of the intermediate plate 4, i.e., the surface which partitions the space section 5, a groove 10*a* which extends from the inlet 7 to an outer peripheral portion 4*b* of the intermediate plate 4 and a groove 10*b* which extends from the outlet 8 to the outer peripheral portion 4*b* of the intermediate plate 4 are formed. The outer peripheral portion of the intermediate plate in the present invention is a portion placed above an outer peripheral portion of the space section, and the grooves 10*a* and 10*b* can be extended to at least the lower end surface 4*a* of the intermediate plate 4 above the outer peripheral portion of the space section 5. Alternatively, they may be extended to the lower end portion 4*a* of the intermediate plate 4 above an outer peripheral end of the space section 5.

Such a polishing head 1 can rub and polish a front surface of wafer with a polishing pad attached to a turntable while, holding a back surface of the wafer on the lower surface portion of the elastic film 3. Further, the polishing head 1 may have a backing pad attached to the lower surface portion of the elastic film 3, and the elastic film 3 may hold the wafer through this backing pad. The backing pad mentioned here is, e.g., a member which is soaked with water and attached to the wafer so that the wafer is held on a wafer holding surface of the elastic film 3. Furthermore, the polishing head 1 may include an annular template which holds an edge portion of the wafer on a lower surface of the backing pad.

In such a polishing head 1, since an amount of air remaining in the space section 5 is very small, a shape of the surface of the elastic film on which the wafer is held can be easily controlled at the time of polishing the wafer. Consequently, the polishing head which can manufacture the wafer having high flatness with excellent reproducibility can be provided.

Subsequently, a method for manufacturing a polishing head according to the present invention which enables manufacturing such a polishing head of the present invention as shown in FIG. 1 and FIG. 2 will now be specifically described.

Figure 3:
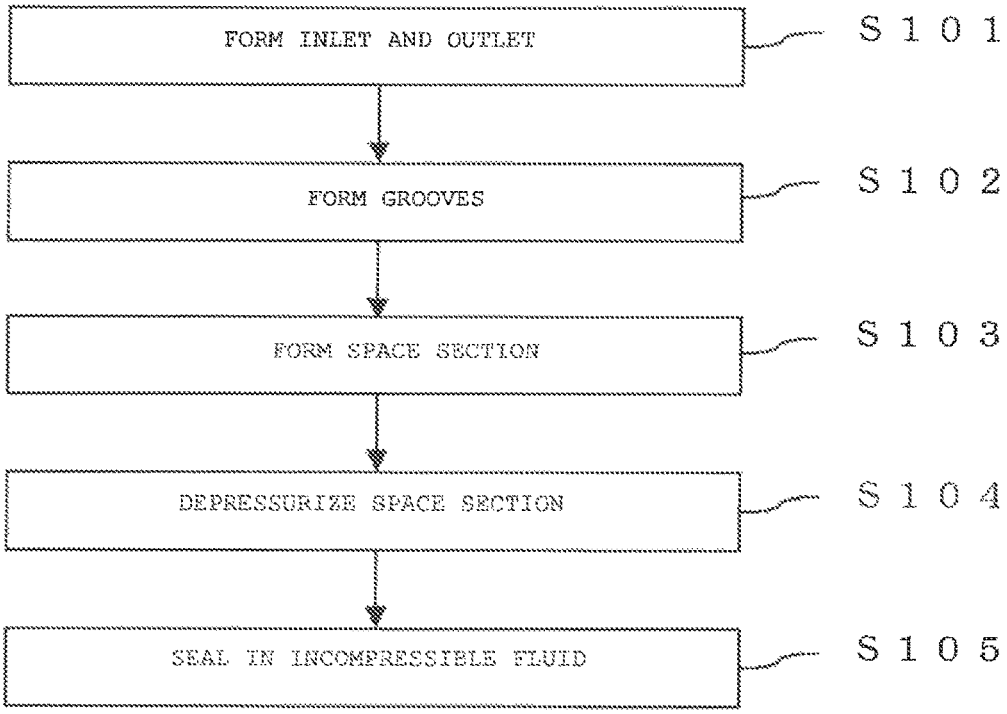
FIG. 3 is a flowchart to explain an example of a method for manufacturing a polishing head according to the present invention.

As shown in FIG. 3, the method for manufacturing a polishing head according to the present invention has at least forming the inlet and the outlet in the intermediate plate (S101 in FIG. 3), forming the grooves on the lower end surface of the intermediate plate (S102 in FIG. 3), combining the intermediate plate, the rigid ring, and the elastic film to form the space section (S103 in FIG. 3), depressurizing the inside of the space section (S104 in FIG. 3), and sealing the incompressible fluid in the space section (S105 in FIG. 3).

First, before coupling the intermediate plate 4 with the upper end surface of the rigid ring 2, formation of such an inlet 7 and outlet 8 as shown in FIGS. 1 and 2 in the lower end surface 4*a* of the intermediate plate 4 (S101 in FIG. 3) is performed. As the intermediate plate 4, it is preferable to use stainless used steel (SUS) in terms of strength or a price. Furthermore, for example, like manufacture of a polishing head which is used for polishing a large-diameter wafer having a diameter of 300 mm or more, a reduction in weight of the polishing head is required, titanium can be used.

Subsequently, on the lower end surface 4*a* of the intermediate plate 4, such grooves 10*a* and 10*b* as shown in FIG. 2 are formed (S102 in FIG. 3). Specifically, the groove 10*a* which couples the inlet 7 with an arbitrary point on the outer peripheral portion 4*b* is formed. Likewise, the groove 10*b* which couples the outlet 8 with an arbitrary point on the outer peripheral portion 4*b* is formed. FIG. 2 shows an example where the grooves 10*a* and 10*b* are formed so that they extend from the inlet 7 and the outlet 8 to the nearest outer peripheral portions, respectively. A cross-sectional shape of each groove formed in the intermediate plate can be, e.g., a square shape having a width of 1 to 5 mm and a depth of 3 to 6 mm, but it is not restricted thereto. A shape of the groove may be any shape as long as it does not inhibit flows of the air and the incompressible fluid and does not affect strength of the intermediate plate.

After forming the inlet 7, the outlet 8, and the grooves 10*a* and 10*b* in the intermediate plate 4 as described above, the elastic film 3 is attached to the lower end surface of the rigid ring 2 and the upper end surface of the rigid ring 2 is coupled with the lower end surface 4*a* of the intermediate plate 4 having the grooves formed, thereon as shown in FIG. 1, thereby forming the space section 5 (103 in FIG. 3). The space section 5 may be formed by assembling assemblies, i.e., the rigid ring and the rubber film, and the intermediate plate. It is preferable for a material of the rigid ring to be ceramics to avoid dissolution of metal impurities during polishing of the wafer.

Subsequently, the inside of the space section 5 is depressurized (S104 in FIG. 3). Specifically, the outlet 8 is coupled with a vacuum generator such as an ejector (not shown), and the inside of the space section 5 can be depressurized by operating the vacuum generator. It is to be noted that a supply pressure of the ejector is preferably approximately 3 MPa. Further, when the ejector is operated for one minute or more, the inside of the space section 5 can be sufficiently depressurized. Consequently, at least a central portion of the lower end surface 4*a* of the intermediate plate 4 is appressed against the elastic film 3.

Then, the incompressible fluid 6 is poured from the inlet 7 while keeping the outlet 8 open. As the incompressible fluid 6, using water is preferable in terms of safety and convenience. Moreover, it is preferable to set an inlet velocity to approximately 700 ml/min to 900 ml/min.

Figure 4:
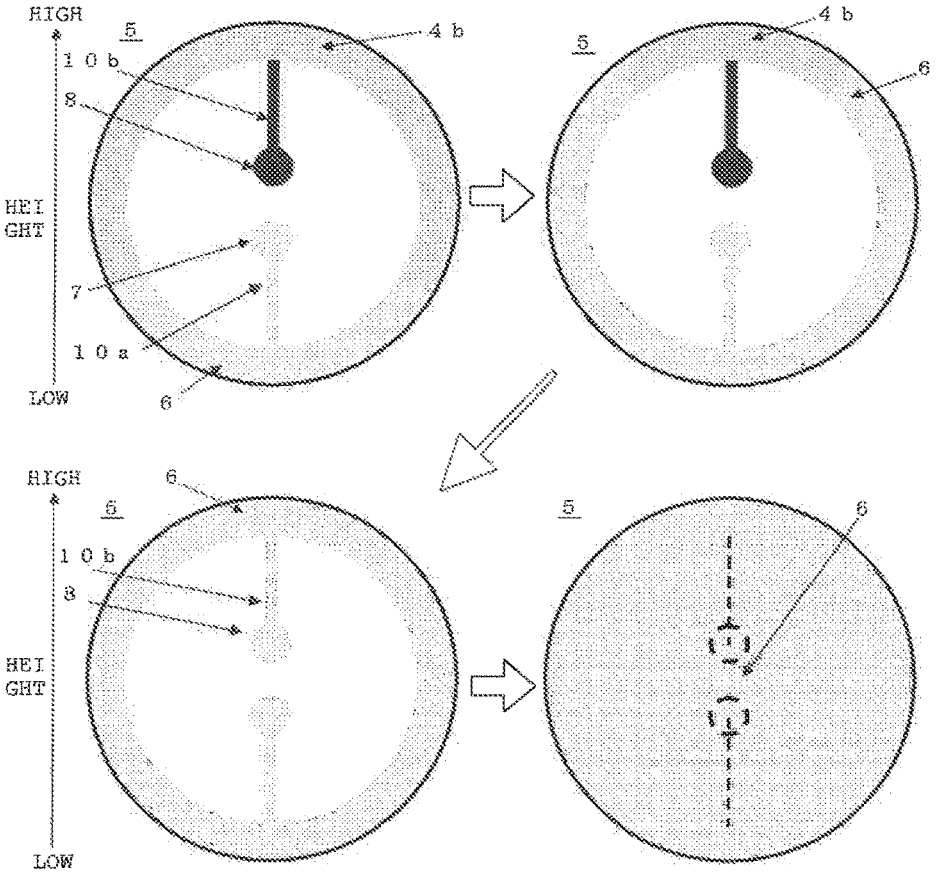
FIG. 4 is a schematic view showing movements of an incompressible fluid at the time of pouring the incompressible fluid.

In a state where the central portion of the lower end surface 4*a* of the intermediate plate 4 is appressed against the elastic film 3 in this manner, when the incompressible fluid 6 is poured into the space section 5, the incompressible fluid 6 moves in the space section 5 as shown in FIG. 4. First, the incompressible fluid 6 is poured into the space section 5 from the inlet 7. Subsequently, the incompressible fluid 6 spreads from the inlet 7 toward the outer peripheral portion 4*b*, i.e., flows to a lower side of the outer peripheral portion 4*b* of the intermediate 4, in other words, the outer peripheral portion of the space section 5 through the groove 10*a* connecting the inlet 7 with the outer peripheral portion of the space section 5 (an upper left part in FIG. 4).

At this time, as shown in FIG. 4, it is preferable to pour the incompressible fluid 6 into the space section 5 in a state where the intermediate plate 4 coupled with the rigid ring is mounted at a slant so that the inlet 7 is placed below the outlet 8. That is, it is preferable to mount the intermediate plate 4 so that a height position of the groove 10*b* connected with the outlet 8 becomes lower than a height position of the groove 10*a* connected with the inlet 7. Additionally, specifically, it is preferable to give an inclination of approximately five degrees from a horizontal plane to the intermediate plate 4. When the intermediate plate 4 is mounted at a slant in this manner, the incompressible fluid 6 which has been poured from the inlet 7 is apt to flow into the space of the outer peripheral portion 4*b* through the groove 10*a* on a preferential basis.

Then, the incompressible fluid 6 flows along the outer peripheral portion 4*b* of the intermediate plate 4 and fills the outer peripheral portion of the space section 5 (an upper right part in FIG. 4). At this time, air present in the outer peripheral portion of the space section 5 is simultaneously discharged. It is to be noted that the central portion of the intermediate plate 4 is in a state where the intermediate plate 4 and the elastic film 3 are adsorbed by depressurization, and hence the incompressible fluid 6 does not flow.

Here, in the present invention, it is preferable to use, as the intermediate plate 4, a member having a convex shape as the shape of the lower end surface 4*a*. When the intermediate plate 4 having such a shape is used, the incompressible fluid 6 is further apt to flow along the outer peripheral portion 4*b* of the intermediate plate 4. That is, a flow of the incompressible fluid 6 in the space section 5 can be easily controlled.

Subsequently, the incompressible fluid 6 reaches the outlet 8 through the groove 10*b* (a lower left part in FIG. 4). Almost all the air remaining in the outer peripheral portion can be efficiently discharged by the movements of the incompressible fluid 6 so far. It is to be noted that the replacement of the space in the outer peripheral portion 4*b* by the incompressible fluid 6 can be determined to be complete when the incompressible fluid 6 starts to be discharged from the outlet 8 in place of the air. After completion of discharge of the air, when the outlet 8 is closed, while pouring the incompressible fluid 6 is kept, water is also poured to a part where the elastic film 3 and the intermediate plate 4 are adsorbed in the central portion (a lower right part in FIG. 4). Then, the incompressible fluid 6 is poured until a desired sealing amount, is reached, and the inlet 7 is closed at last. An amount of the incompressible fluid to be sealed in can be calculated from a pouring amount, and a discharging amount, and it can be managed by measuring weights of the polishing head before and after sealing.

When the polishing head is manufactured based on such a procedure as described above, an amount of the air remaining in the space section 5 having the incompressible fluid 6 sealed in can be greatly reduced. Thus, it is possible to assuredly manufacture the polishing head according to the present invention which facilitates controlling the shape of the surface of the elastic film on which the wafer is held and enables manufacturing the wafer having high flatness with excellent reproducibility.

Figure 5:
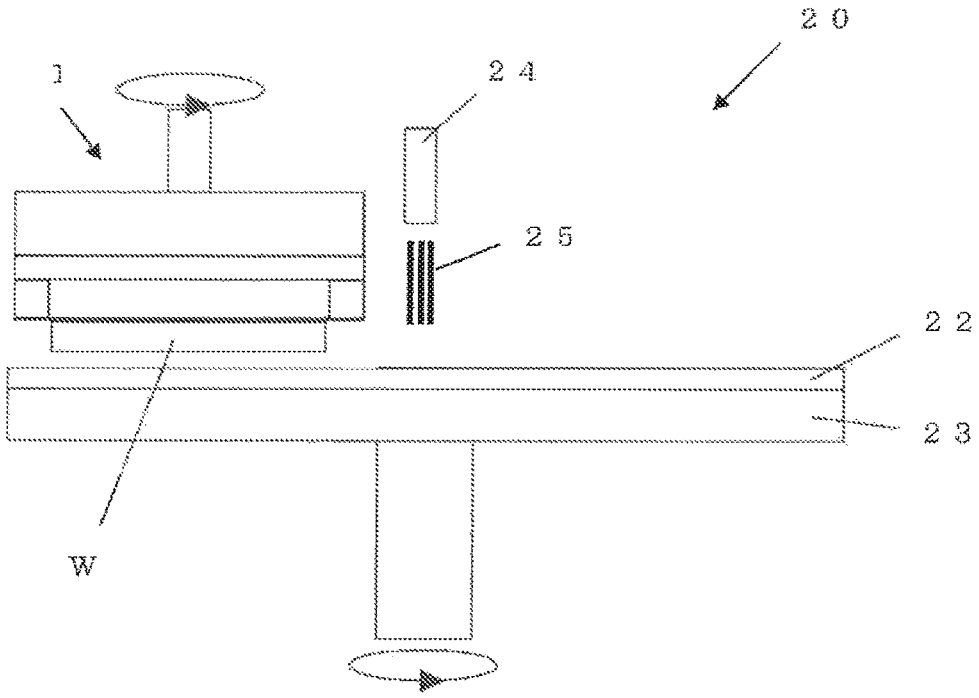
FIG. 5 is a schematic view showing an example of a polishing apparatus according to the present invention.
Figure 6:
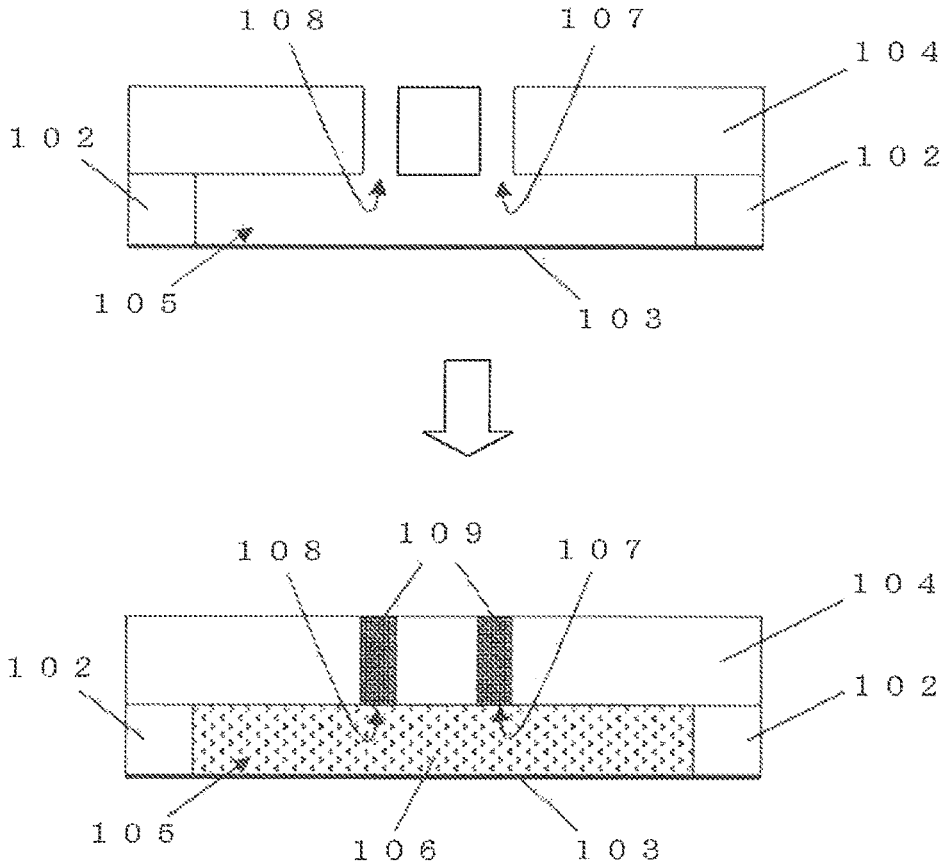
FIG. 6 is a schematic view showing a case where the incompressible fluid is poured into a space section by a conventional depressurizing and sealing-method.
Figure 7:
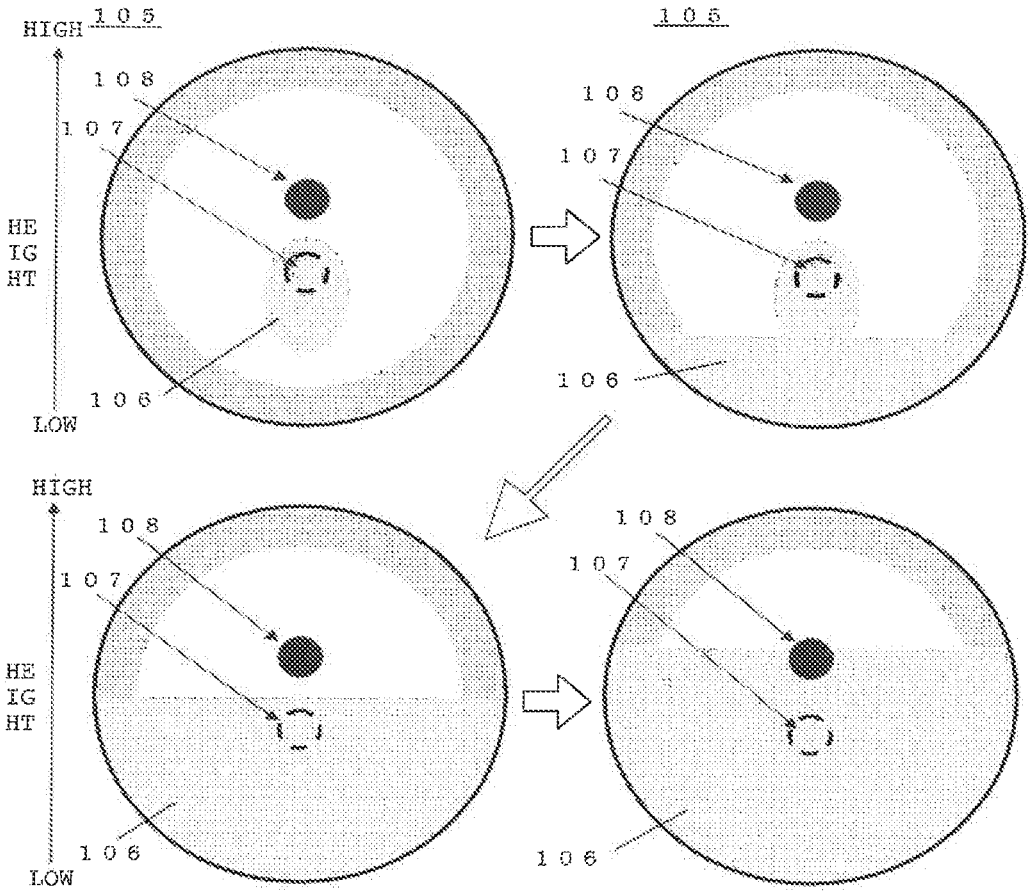
FIG. 7 is a schematic view showing movements of the incompressible fluid when the incompressible fluid is poured into the space section by the conventional depressurizing and sealing method.

Further, the polishing head 1 according to the present invention manufactured in this manner can be used for holding a wafer W by, e.g., such a polishing apparatus 20 of the present invention as shown in FIG. 5. As shown in FIG. 5, the polishing apparatus 20 according to the present invention has a polishing pad 22 attached to an upper side of a turntable 23, a polishing agent supply mechanism 24 which supplies a polishing agent 25 onto the polishing pad 22, and the polishing head 1 of the present invention as a polishing head configured to hold a workpiece W. This polishing head 1 is configured to press the workpiece W against the polishing pad 22 attached to the turntable 23 by a non-illustrated pressurizing mechanism.

Furthermore, a surface of the workpiece W is rubbed and polished by a rotation movement of the polishing head 1 coupled with a rotary shaft and a turning movement of the turntable 23 while supplying a polishing agent 25 to the upper side of the polishing pad 22 by the polishing agent supply mechanism 24. According to such a polishing apparatus 20, a wafer having high flatness can be manufactured with excellent reproducibility.

EXAMPLES

Although the present invention will now be more specifically described hereinafter with reference to an example and comparative examples of the present invention, the present invention is not restricted thereto.

Example

A polishing head was manufactured by the method, for manufacturing a polishing head according to the present, invention based, on a flow shown in FIG. 3. At this time, as an intermediate plate 4, a discoid intermediate plate which has a convex lower end surface 4*a*, is made of SUS, and has a diameter of 360 mm and was used. Both grooves 10*a* and 10*b* formed on the intermediate plate were grooves each of which has a rectangular cross-sectional shape with a width of 3 mm and a depth of 4.5 mm. Moreover, as an incompressible fluid 6, water was used. Further, an inlet velocity of the water to a space section was set to 800 ml/min.

Comparative Example 1

A polishing head was assembled in the water which is the incompressible fluid to fabricate the polishing head having the water sealed in the space section. The polishing head fabricated in Comparative Example 1 has a basic structure equal to that of the polishing head in Example 1, but it does not have grooves, an inlet, an outlet, and a lid sections on a lower end surface of an intermediate plate.

Comparative Example 2

A polishing head was basically manufactured in the same manner as Example 1 except that a groove extending from an inlet to an outer peripheral portion of an intermediate plate and a groove extending from an outlet to the outer peripheral portion of the intermediate plate were not formed and water was sealed in a space section by a conventional depressurizing and sealing method.

Workability, an air residual amount, and sealing amount controllability in each of Example and Comparative Examples 1 and 2 were evaluated.

Here, the workability was evaluated in terms of a polishing head assembly operation time, a time of five minutes or less was evaluated as "good", and a time of five minutes or more was evaluated as "poor". As shown in Table 1, in each Example 1 and Comparative Example 2 using the depressurizing and sealing method, since the work can be performed in a state where the polishing head, is assembled in air, an operation time was reduced as compared with a method for assembling the head in the incompressible fluid. It is to be noted that an operation time in Example is a time which is ⅓ or less of that of Comparative Example 2.

The air residual amount was converted into an area, an amount which is 3% or less of the space section was evaluated as "good", and an amount which is 3% or more was evaluated as "poor". Consequently, in Comparative Example 1 adopting an underwater assembling system, the remaining air was 0% when it was converted into an area, and hence it was evaluated as "good". Further, in the polishing head manufactured by the present invention, the remaining air was slightly observed, but it was approximately 1% when it was converted into an area, and hence it was evaluated as "good". It is to be noted that this is an air residual amount which does not adversely affect polishing of a wafer. On the other hand, in the polishing head of Comparative Example 2, since the remaining air was 20% when it was converted into an area, it was evaluated as "poor".

In the underwater assembling system in Comparative Example 1, the sealing amount controllability was evaluated as "poor" since a sealing amount of the water was not successfully adjusted. On the other hand, in the depressurizing and pouring method like Example, since a sealing amount of water can be controlled by an amount of the incompressible fluid to be supplied, and hence the controllability was evaluated as "good". In case of the polishing head of Comparative Example 2, even if a sealing amount of water can be controlled, a desired amount of the incompressible fluid cannot be sealed in due to an influence of the remaining air, and a shape of a wafer holding section of the polishing head cannot be actually fixed. Thus, it was evaluated as "substantially poor".

TABLE 1

| | Example | Comparative Example 1 | Comparative Example 2 |
|---|---|---|---|
| Workability | Good | Poor | Good |
| Air residual amount | Good | Good | Poor |
| Sealing amount controllability | Good | Poor | Substantially poor |

Moreover, the polishing head manufactured in each of Example and Comparative Example 1 was used as a polishing head of such a single-side polishing apparatus as shown in FIG. 5, and a silicon single crystal wafer with a diameter of 300 mm was subjected to single-side polishing. At this time, a nonwoven fabric was used as a polishing pad, and an alkali based polishing liquid containing colloidal silica as abrasive grains was used as a polishing agent. Further, a rotation speed of the turntable was set to 30 rpm, and a rotation speed of the polishing head was set to 30 rpm. Furthermore, pressing force of the polishing head to a wafer was set to 20 kPa.

A silicon single crystal wafer was polished under these conditions, and its flatness was evaluated. Table 2 shows the results. For the evaluation of the flatness, an average value of outer periphery stock removal variations was used. The outer periphery stock removal variation mentioned here represents a difference between stock removals at points which are 1 mm and 3 mm apart from the outer periphery toward the center respectively and, when this value is lowered, it means that even the outer peripheral portion is flatly polished. It is to be noted that, in Comparative Example 2, since an air residual volume is large, the wafer could not be properly handled when the same sealing amount as that in Example or Comparative Example 1 was set, and hence data of the outer periphery stock removal variation was not provided.

TABLE 2

| | Example | Comparative Example 1 |
|---|---|---|
| Outer periphery stock removal variation | 12 nm | 17 nm |

It is to be noted that the present invention is not restricted to the embodiment. The embodiment is an illustrative example, and any example which has substantially the same configuration and exerts the same functions and effects as the technical concept described in claims of the present invention is included in the technical scope of the present invention.

The invention claimed is:

1. A method for manufacturing a polishing head which comprises: an annular rigid ring; an elastic film attached to a lower end surface of the rigid ring by uniform tensile force; a discoid intermediate plate coupled with an upper end surface of the rigid ring; a space section partitioned by a lower end surface of the intermediate plate, an upper surface of the elastic film, and an inner peripheral surface of the rigid ring; and an incompressible fluid sealed in the space section, wherein the polishing head is configured to rub and polish a front surface of a wafer with a polishing pad attached to an upper side of a turntable while holding a back surface of the wafer on a lower surface portion of the elastic film, the method comprising, before coupling the intermediate plate with the upper end surface of the rigid ring:

forming, in the intermediate plate, an inlet through which the incompressible fluid is poured into the space section and an outlet through which air is discharged from the space section at the time of pouring the incompressible fluid; and forming, on a lower end surface of the intermediate plate, a groove which extends from the inlet to an outer peripheral portion of the intermediate plate and a groove which extends from the outlet to the outer peripheral portion of the intermediate plate, the method comprising, after attaching the elastic film to the lower end surface of the rigid ring and coupling the upper end surface of the rigid ring with the lower end surface of the intermediate plate having the grooves formed thereon to form the space section:

depressurizing the inside of the space section; and discharging the air in the space section from the outlet while pouring the incompressible fluid into the space section from the inlet after the depressurizing, and closing the inlet and outlet to seal the incompressible fluid in the space section.

2. The method for manufacturing a polishing head according to claim 1, wherein, in sealing the incompressible fluid in the space section, the incompressible fluid is poured into the space section while mounting the intermediate plate at a slant so that the inlet is placed below the outlet.

3. The method for manufacturing a polishing head according to claim 2, wherein a member whose lower end surface on which the grooves are formed has a convex shape is used as the intermediate plate.

4. The method for manufacturing a polishing head according to claim 1, wherein the intermediate plate comprises a member having a concave shaped lower end surface on which the grooves are formed.

5. A polishing head comprising: an annular rigid ring; an elastic film attached to a lower end surface of the rigid ring by uniform tensile force; a discoid intermediate plate coupled with an upper end surface of the rigid ring; a space section partitioned by a lower end surface of the intermediate plate, an upper surface of the elastic film, and an inner peripheral surface of the rigid ring; and an incompressible fluid sealed in the space section, wherein the polishing head is configured to rub and polish a front surface of a wafer with a polishing pad attached to an upper side of a turntable while holding a back surface of the wafer on a lower surface portion of the elastic film, wherein the intermediate plate comprises, on the lower end surface thereof: an inlet through which the incompressible fluid is poured into the space section; an outlet through which air is discharged from the space section; a groove which extends from the inlet to an outer peripheral portion of the intermediate plate; a groove which extends from the outlet to the outer peripheral portion of the intermediate plate; and lid sections which close the inlet and the outlet.

6. A polishing apparatus comprising: a polishing pad attached to an upper side of a turntable; a polishing agent supply mechanism configured to supply a polishing agent onto the polishing pad; and a polishing head according to claim 5, wherein a workpiece is held by the polishing head, and a front surface of the workpiece is rubbed and polished with the polishing pad attached to the upper side of the turntable.

* * * * *